United States Patent [19]

Farris et al.

[11] Patent Number: 4,752,037

[45] Date of Patent: Jun. 21, 1988

[54] VANE WHEEL ASSEMBLY FOR RB MILLS

[75] Inventors: Lawrence S. Farris, East Granby; David E. Kohler, Enfield, both of Conn.

[73] Assignee: Combustion Engineering, Inc., Windsor, Conn.

[21] Appl. No.: 33,314

[22] Filed: Apr. 1, 1987

[51] Int. Cl.[4] ..... B02C 15/04

[52] U.S. Cl. ..... 241/79.1; 241/80; 241/119

[58] Field of Search ..... 241/117–121, 241/53, 57, 59, 52, 61, 80, 97, 18, 24, 19, 79.1

[56] References Cited

U.S. PATENT DOCUMENTS 4,264,041 4/1981 Kitto et al. ..... 241/119 X
4,523,721 6/1985 Maliszewski et al. ..... 241/119 X

FOREIGN PATENT DOCUMENTS 1152297 8/1963 Fed. Rep. of Germany ..... 241/119

*Primary Examiner*—Mark Rosenbaum
*Attorney, Agent, or Firm*—Arthur E. Fournier, Jr.

[57] ABSTRACT

A vane wheel assembly (12) particularly suited for use in a mill (10) so as to be operative to effect a primary classification of the material such as coal that is subjected to pulverization within the mill (10). The subject vane wheel assembly (12) includes a first channel-like means (40) mounted in supported relation on the bowl (16) of the mill (10) for rotation therewith and so as to lie in a first plane which extends in a first direction. The subject vane wheel assembly (12) further includes a second channel-like means (42) mounted in fixed relation on the interior of the millside area (15) of the mill (10) at the exit end of the first channel-like means (40) so as to extend a full 360° around the circumference of the millside area and so as to lie in a second plane that extends in a second direction which is inclined at a predetermined angle to the first plane of the first channel-like means (40).

9 Claims, 4 Drawing Sheets

VANE WHEEL ASSEMBLY FOR RB MILLS

BACKGROUND OF THE INVENTION

This invention relates to apparatus for pulverizing, i.e., grinding, material, and more specifically to a vane wheel assembly that is particularly suited for embodiment in a mill wherein the vane wheel assembly is operative to effect a primary classification of the pulverized material.

It has long been known in the prior art to provide apparatus employable for purposes of effecting the grinding of materials. More specifically, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is, in turn, attributable for the most part to the diverse functional requirements that are associated with the individual applications in which such apparatus are designed to be employed. For instance, in the selection of the particular type of apparatus that is to be utilized for a specific application, one of the principal factors to which consideration must be given is that of the nature of the material that is to be ground in the apparatus. Coal is one such material wherein there is a need to grind it in order to render it suitable for use in certain applications. Furthermore, fossil fuel fired power generation systems represent one such application in which it is desired to employ coal, as the source of fuel therefor, and wherein a requirement exists to grind, i.e., pulverize, the coal to render it suitable for use for this purpose, i.e., for use in a coal-fired power generation system.

For purposes of the discussion that follows, the coal-fired power generation systems referred to above are considered to consist of essentially the following major operating components: a coal feeder, apparatus for pulverizing coal, a distribution system for distributing the coal after the pulverization thereof, a furnace in which the coal is to be burned, and the requisite controls for effecting the proper operation of the coal-fired power generation system. Of particular interest herein is that portion of the coal-fired power generation system which has been identified above as the apparatus for pulverizing the coal. Coal pulverizing apparatus are not new. They have been known to exist in the prior art for more than half a century. Furthermore, many improvements in the construction and/or mode of operation of coal pulverizing apparatus have been made during this period.

There are a number of features that it is advantageous for any coal pulverizing apparatus to possess, but particularly those which are designed for employment in a coal-fired power generation system. Reference is had here to features such as reliability, low power consumption, minimum maintenance and wide range of capacity. In addition, such apparatus advantageously should also be characterized by quiet operation, integrated lubrication systems, convenient adjustment and control of coal flow and fineness, and the ability to handle the high temperature air that is required for high moisture coal.

One particular type of coal pulverizing apparatus which is to be found in the prior art that is advantageously characterized by the embodiment therein of the above-recited features is an apparatus most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl.

Reference may be had, by way of exemplification, to U.S. Pat. No. 2,079,155, the latter being assigned to the same assignee as the instant application, for a teaching of the nature of the construction and the mode of operation of a prior art form of bowl mill that is suitable for use in a coal-fired power generation system to effectuate the pulverization of the coal that is to be burned as fuel therein. As taught by the aforementioned patent, a bowl mill essentially consists of a body portion in which a grinding table is mounted for rotation, a plurality of grinding rollers that coact with the grinding table to effect the grinding of coal interposed therebetween, coal supply means for feeding to the interior of the bowl mill the coal that is to be pulverized, and air supply means for supplying to the interior of the bowl mill the air required in the operation of the latter. In accordance with the mode of operation of such a bowl mill, the coal which enters the bowl mill is pulverized by virtue of the coaction of the grinding rollers with the grinding table. After being pulverized, the coal particles are thrown outwardly by centrifugal forces whereby the particles are fed into a stream of air that is entering the bowl mill. The stream of air, which now contains pulverized coal particles, flows through a tortuous path that is established in part by the positioning within the bowl mill of a suitably supported deflector means. As the stream of air and coal particles flows along the aforementioned tortuous path, the sharp turns contained therein effects the separation of the coarse coal particles from the air stream. These coarse coal particles are then suitably returned to the grinding table for further pulverization, while the fine coal particles are carried through the bowl mill in the air stream, and exit therefrom along with the air. In a conventional coal-fired power generation system, a multiplicity of bowl mills of the type shown in the aforementioned patent would commonly be employed for purposes of satisfying the requirements of the system for pulverized coal.

Although bowl mills constructed in accordance with the teachings of the prior art have, under actual operating conditions, proven capable of providing adequate performance to date, a need has nevertheless been evidenced for improvements to be made therein. One area, for example, in which prior art forms of bowl mills have heretofore been known to be disadvantageously characterized is that of the manner in which the air is made to flow through the deflector portion of the bowl mill. More specifically, reference is had here to the fact that prior art forms of mills have heretofore been disadvantageously characterized by virtue of the fact that the design thereof is such that in accordance therewith the air required in the operation of the mill is made to flow through the deflector portion of the mill at a very high velocity, relatively speaking. On the other hand, it is desirable from an operational and performance standpoint to have the air required in the operation of the mill flow through the deflector portion of the mill at the lowest possible velocity. There are a number of reasons for this. By way of exemplification and not limitation, one of these resides in the fact that a lower velocity results in a lower pressure drop across the bowl portion of the mill. This in turn reduces the total pressure drop across the mill with the concomitant result that for the same flow through the mill of material to be pulverized, it is possible to realize either a gain in air flow or a reduction in power consumption. The significance of a gain in air flow is that greater air flow translates into larger mill capacity or greater drying capability. Another reason is that the lower the velocity of the air in which the particles of pulverized material are entrained, the better the particle classification which occurs within the mill and thus the better the fineness control that one is able to achieve with the mill. A third reason is that the lower the velocity at which the air in which the particles of pulverized material are entrained flows through the deflector portion of the mill, the less the wear on the separator body internals of the mill. A fourth reason is that a lower air flow means that it is possible to reject more pyrites thereby reducing the wear on the upper millside area of the mill. In summary, therefore, a need has been evidenced in the prior art for a new and improved vane wheel assembly, which when employed in a bowl mill so as to be operative to effect a primary classification of the material such as coal that is subjected to pulverization within the mill, is characterized by the low velocity at which the air is made to flow when passing through the deflector portion of the bowl mill.

It is, therefore, an object of the present invention to provide a new and improved vane wheel assembly that is suitably constructed so as to be employable in a bowl mill for purposes of effecting a primary classification of the material that is pulverized in the bowl mill.

It is another object of the present invention to provide such a vane wheel assembly for bowl mills wherein by virtue of the low velocity at which the air is made to flow through the vane wheel assembly there results a lower pressure drop across the bowl portion of the bowl mill and thereby a reduction in the total pressure drop across the bowl mill with the concomitant result that for the same flow of pulverized material through the bowl mill it is possible to realize either a gain in air flow or a reduction in power consumption.

It is still another object of the present invention to provide such a vane wheel assembly for bowl mills wherein by virtue of the low velocity at which the air is made to flow through the vane wheel assembly there results a better classification within the bowl mill of the particles of pulverized material and thus better fineness control.

A further object of the present invention is to provide such a vane wheel assembly for bowl mills wherein by virtue of the low velocity at which the air is made to flow through the vanes wheel assembly the separator body internals of the bowl mill are subjected to less wear.

A still further object of the present invention is to provide such a vane wheel assembly for bowl mills wherein by virtue of the low velocity at which the air is made to flow through the vane wheel assembly the upper millside area of the bowl mill is subjected to less wear.

Yet another object of the present invention is to provide such a vane wheel assembly for bowl mills which is suitable for employment in retrofit applications as well as being suitable for employment in newly constructed bowl mills.

Yet still another object of the present invention is to provide such a vane wheel assembly for bowl mills which is advantageously characterized by its ease of manufacture and its ease of installation in a bowl mill, as well as by the fact that it is relatively inexpensive to provide.

SUMMARY OF THE INVENTION

In accordance with the present invention there is provided a vane wheel assembly which is particularly suited for use in a mill so as be operative to effect a primary classification of the material such as coal that is subjected to pulverization within the mill. The subject vane wheel assembly includes a first channel-like means and a second channel-like means. The first channel-like means, which is mounted in supported relation on the bowl of the mill for rotation therewith and so as to lie in a first plane that extends in a first direction, defines a first channel-like passage. The first channel-like passage embodies an area of predetermined dimensions which corresponds to the area which is required in order that the highest expected volume of air may flow through the first channel-like means at a preestablished specified velocity. As employed here, the highest expected volume of air is the volume of air that is designed to flow through the first channel-like means at the highest allowable air inlet temperature. Continuing, the second channel-like means, which is mounted in fixed relation on the interior of the millside portion of the mill at the exit end of the first channel-like means and so as to lie in a second plane that extends in a second direction that is inclined at a predetermined angle to the first plane of the first channel-like means, defines a second channel-like passage. The second channel-like passage embodies an area of predetermined dimensions corresponding to the area that is required in order that the air when flowing through the second channel-like means flows at a preestablished specific velocity which bears a fixed relationship to the velocity of the air when the air is flowing through the first channel-like means.

DESCRIPTION OF A PREFERRED EMBODIMENT

Figure 1:
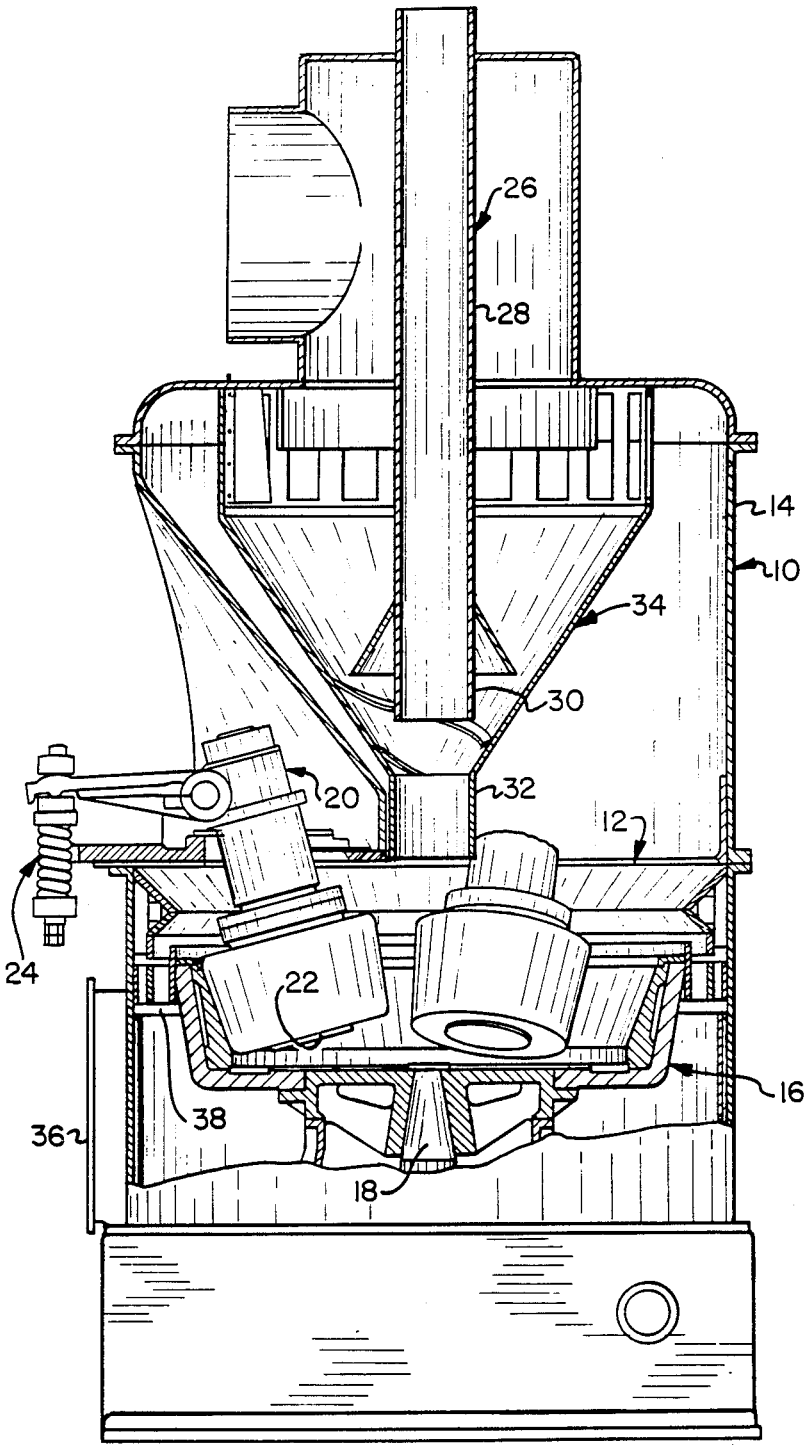
FIG. 1 is a side elevational view partially in section of a bowl mill in which there is installed a vane wheel assembly constructed in accordance with the present invention.
Figure 2:
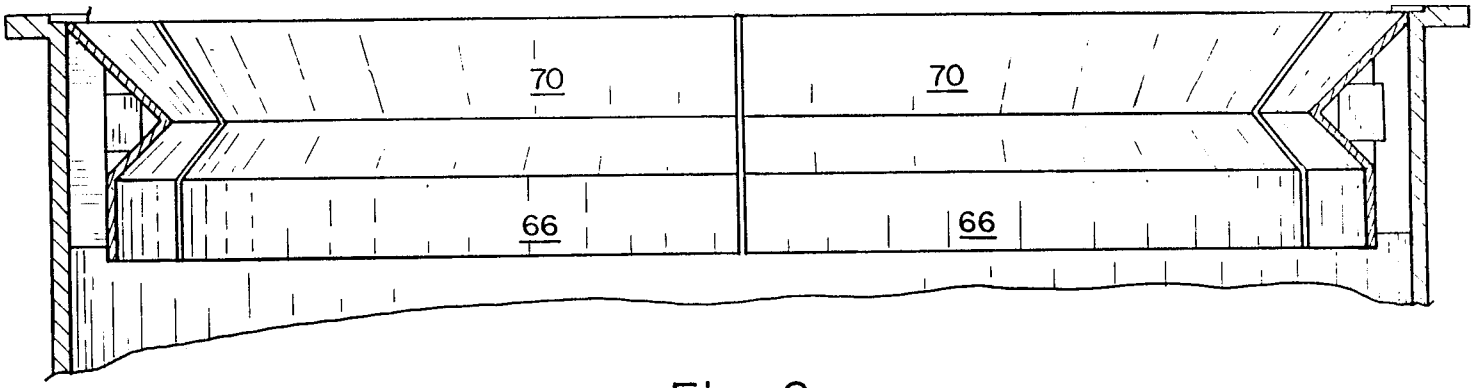
FIG. 2 is a side elevational view partially in section of the second channel-like means of a vane wheel assembly for bowl mills constructed in accordance with the present invention.

Referring now to the drawing, and more particularly to FIG. 1 of the drawing, there is depicted therein a bowl mill, generally designated by reference numeral 10. Inasmuch as the nature of the construction and the mode of operation of bowl mills per se are well-known to those skilled in the art, it is not deemed necessary, therefore, to set forth herein a detailed description of the bowl mill 10 illustrated in FIG. 1. Rather, for purposes of obtaining an understanding of a bowl mill 10 in which a vane wheel assembly, generally designated by the reference numeral 12 in FIG. 1 of the drawing, constructed in accordance with the present invention is capable of being installed and when so installed therein is operative to effect a primary classification of the material, e.g., coal, that is subjected to the pulverization within the bowl mill 10, it is deemed sufficient that there be presented herein merely a description of the nature of the components of the bowl mill 10 with which the vane wheel assembly 12 coacts. For a more detailed description of the nature of the construction and the mode of operation of the components of the bowl mill 10, which are not described in detail herein, one may have reference to the prior art.

Referring further to FIG. 1 of the drawing, the bowl mill 10 as illustrated therein includes a substantially closed body portion comprised of the separator body 14 and the millside area 15. A grinding table 16 is mounted on a shaft 18, which in turn is operatively connected to a suitable drive mechanism (not shown) so as to be capable of being rotatably driven thereby. With the aforesaid components arranged within the closed body portion in the manner depicted in FIG. 1 of the drawing, the grinding table 16 is designed to be driven in a clockwise direction.

Continuing with a description of the bowl mill 10, a plurality of grinding rolls 20, preferably three in number in accord with conventional practice, are suitably supported within the interior of the separator body 14 so as to be equidistantly spaced one from another around the circumference of the closed body portion. In the interest of maintaining clarity of illustration in the drawing, only two such grinding rolls 20 have been shown in FIG. 1. With further regard to the grinding rolls 20, each of the latter as best understood with reference to FIG. 1 of the drawing is preferably supported on a shaft 22, which in turn is cooperatively associated with some form of biasing means. By way of exemplification, the latter biasing means may take the form of the spring means denoted generally by the reference numeral 24 in FIG. 1 of the drawing. However, the biasing means could equally well take the form of hydraulic means. In any event whatever the nature of the biasing means, it is intended to be operative to urge the shaft 22 and thereby the grinding roll 20 cooperatively associated therewith towards the surface of the grinding table 16. Commonly, the spring means 24 is provided with some form of adjustment means through the operation of which adjustments can be made in the spacing that exists between the grinding roll 20 and the surface of the grinding table 16 on which the pulverization of the material, e.g., coal, occurs.

It is important to note here that in accord with the nature of the construction of the bowl mill 10, the grinding rolls 20 are suitably mounted so as to be located along with the grinding table 16 in the millside area 15 of the bowl mill 10. This is in contrast to the nature of the construction of the bowl mills depicted, for example, in U.S. Pat. No. 2,698,142 which issued Dec. 28, 1954 to J. Crites et al and in U.S. Pat. No. 4,523,721 which issued on June 18, 1985 to T. V. Maliszewski et al wherein in accord with the teachings of each of these patents the grinding rolls are located in the separator body portion of the bowl mill and not in the millside area thereof. Furthermore, note is taken here of the fact that unlike the bowl mills depicted in U.S. Pat. Nos. 2,698,142 and 4,523,721, the bowl mill 10 as will be best understood with reference to FIG. 1 of the drawing is provided with preferably three alcoves, i.e., cavity portions, only one of which is illustrated in FIG. 1 of the drawing in the interest of maintaining larity of illustration therein, wherein the alcove, i.e., cavity portion is identified by the reference numeral 19. Continuing, as will be best understood with reference to FIG. 1 of the drawing, each of the alcoves 19, each of which is open to the atmosphere, has a journal assembly positioned therewithin in supported relation thereto. Each of the journal assemblies in turn, in a manner well-known to those skilled in this art, has cooperatively associated therewith one of the grinding rolls 20. More specifically, with regard to each of the alcoves 19, the journal assembly positioned in supported relation thereto has a portion thereof which projects outwardly of the bowl mill 10 into the alcove 19 and a portion thereof that passes through the member identified by the reference numeral 21 in FIG. 1, which to those skilled in this art is referred to a saddle, so as to extend into the millside area 15 of the bowl mill 10, the latter portion of the journal assembly has the grinding roll 20 mounted thereon. In addition to functioning as a support member for the journal assembly, the saddle 21 is also operative to seal off the millside area 15 of the bowl mill 10 from the alcove 19 which as noted previously herein is open to the atmosphere. From the preceding discussion it should now be readily apparent that in accord with the nature of the construction of the bowl mill 10 as illustrated in FIG. 1 of the drawing, each journal assembly has a portion thereof which projects outwardly of the millside area 15 of the bowl mill 10 into a corresponding one of the alcoves 19. In contrast thereto, the bowl mills constructed in accordance with the teachings of U.S. Pat. Nos. 2,698,142 and 4,523,721, however, embody a construction wherein the journal assemblies are located in the separator body portion of the bowl mill. The significance of this difference is that in accord with the teachings of the present invention the portion of the vane wheel assembly 12 which is mounted in fixed relation on the interior of the bowl mill 10 extends a full 360° around the circumference of the millside area 15 of the bowl mill, whereas in accord with the teachings of U.S. Pat. Nos. 2,698,142 and 4,523,721, the portion of the vane wheel assembly that is mounted in fixed relation on the interior of the bowl mill does not extend a full 360° around the circumference of the separator body portion of the bowl mill. The reason for this is that in accord with the teachings of the nature of the construction of the bowl mills depicted in each of U.S. Pat. Nos. 2,698,142 and 4,523,721 an opening is provided for each of the three journal assemblies in the separator body portion. As such, the effect of the existence of these three openings in the separator body potion is to prevent the positioning therewithin of the portion of the vane wheel assembly that is mounted in fixed relation on the interior of the bowl mill. To thus summarize, in accord with the teachings of U.S. Pat. Nos. 2,698,142 and 4,523,721 the portion of the vane wheel assembly mounted in fixed relation on the interior of the bowl mill does not extend a full 360° around the circumference of the bowl mill thereby creating areas within the bowl mill in which there is no structure to direct air flow.

The material, e.g., coal, that is to be pulverized in the bowl mill 10 is fed thereto by means of any suitable conventional form of feed means. By way of exemplification in this regard one such feed means that may be employed for this purpose is a belt feeder means (not shown). Upon being discharged from the feed means (not shown), the coal enters the bowl mill 10 by means of a coal supply means, generally designated by reference numeral 26, with which the closed body portion is suitably provided. In accordance with the embodiment of the bowl mill 10 illustrated in FIG. 1, the coal supply means 26 includes a suitably dimensioned duct 28 having one end thereof which extends outwardly of the closed body portion and preferably terminates in a funnel-like member (not shown). The latter member (not shown) is suitably shaped so as to facilitate the collection of the coal particles entering the bowl mill 10, and the guiding thereafter of these coal particles into the duct 28. The other end 30 of the duct 28 of the coal supply means 26 is operative to effect the discharge of coal onto the surface of the grinding table 16. To this end, as shown in FIG. 1 of the drawing, the duct end 30 preferably is suitably supported within the closed body portion through the use of any suitable form of conventional support means (not shown) such that the duct end 30 is coaxially aligned with the shaft 18 that supports the grinding table 16 for rotation, and is located in spaced relation to a suitable outlet 32 provided in the classifier, generally designated by reference numeral 34, through which the coal flows in the course of being fed onto the surface of the grinding table 16.

In accord with the mode of operation of bowl mills that embody the form of construction depicted in FIG. 1, a gas such as air is utilized to effect the conveyance of the coal from the grinding table 16 through the interior of the closed body portion for discharge from the bowl mill 10. The air that is used in this connection enters the millside area 15 through a suitable opening, denoted by the reference numeral 36 in FIG. 1, formed therein for this purpose. From the aforesaid opening 36 in the millside area 15 the air flows in surrounding relation from beneath the grinding table 16 to above the surface of the latter. More specifically, the air flows through the space, identified by the reference numeral 38 in FIG. 1, provided for this purpose between the inner wall surface of the millside area 15 and the circumference of the grinding table 16. The path of flow that the air follows thereafter will be described more fully hereinafter in connection with the description of the vane wheel assembly 12 with which the bowl mill 10 in accord with the present invention is provided.

Suffice it to say that as the air is made to flow through the interior of the bowl mill 10, the coal which is disposed on the surface of the grinding table 16 is being pulverized by the action of the grinding rolls 20. As the coal becomes pulverized, the particles that result therefrom are thrown outwardly by centrifugal force away from the center of the grinding table 16. Upon reaching the region of the circumference of the grinding table 16, the coal particles are picked up by the air flowing upwardly from beneath the grinding table 16 and are carried away therewith. Thereafter, and as will be described more fully hereinafter, the stream of air with the coal particles entrained therein follows a tortuous path through the interior of the bowl mill 10. Moreover, in the course of following this tortuous path the larger of the coal particles are caused to be separated from the air stream in which they are entrained and are made to return to the surface of the grinding table 16 whereupon they undergo further pulverization. The lighter of the coal particles, on the other hand, continue to be carried along in the air stream. Ultimately, the combined stream of air and those coal particles that remain entrained therein flows to the classifier 34 to which reference has previously been had hereinbefore.

The classifier 34, in accord with conventional practice and in a manner which is well-known to those skilled in this art, operates to effect a further sorting of the coal particles that remain in the air stream. Namely, those particles of pulverized coal, which are of the desired particle size, pass through classifier 34 and along with the air are discharged therefrom and thereby from the bowl mill 10. On the other hand, those coal particles which in size are larger than desired, are returned to the surface of the grinding table 16 whereupon they undergo additional pulverization. Thereafter, these coal particles are subjected to a repeat of the process described above. That is, the particles are thrown outwardly of the grinding table 16, are picked up by the air exiting from beneath the grinding table 16, are carried along with the air through the yet to be described tortuous path that is provided therefor through the interior of the bowl mill 10, as the air stream follows the aforesaid tortuous path the heavier particles drop back onto the grinding table 16, the lighter particles though continue to be carried along with the air to the classifier 34, those particles which are of the proper size pass through the classifier 34 and exit from the bowl mill 10.

Turning now to a consideration of the nature of the construction which the vane wheel assembly 12 in accord with the present invention embodies, reference will be had in particular for this purpose to FIGS. 2–6 of the drawing. As best understood with reference thereto, the vane wheel assembly 12 includes a first channel-like means, generally designated in FIG. 4 by the reference numeral 40, and a second channel-like means, generally designated in FIG. 4 by the reference numeral 42. In a manner which will be described more fully hereinafter, the first channel-like means 40 is suitably mounted in supported relation on the periphery of the bowl, i.e., the rotatable grinding table 16 of the bowl mill 10. Moreover, the first channel-like means 40 is operative to cause the air flowing in surrounding relation to the grinding table 16 to flow at a preestablished specified velocity therethrough in an upwardly direction as seen with reference to FIG. 1 of the drawing. This has the effect of causing the pulverized material, which is thrown outwardly of the grinding table 16 under the influence of centrifugal force, to become entrained in the flow of air that is exiting from the first channel-like means 40. The second channel-like means 42, on the other hand, as will be described more fully hereinafter, is mounted as will be best understood with reference to FIG. 4 of the drawing in fixed relation on the interior of the millside area 15 of the bowl mill 10 at the exit end of the first channel-like means 40 so as to extend a full 360° around the circumference of the millside area 15 and so as to extend at an inclined angle to the first channel-like means 40. As a consequence of being so mounted, the second channel-like means 42 is operative to cause the flow of air exiting at a preestablished specified velocity from the first channel-like means 40 to flow through the second channel-like means 42 at a preestablished specified velocity which bears a fixed relationship to the velocity of the air when the air is flowing through the first channel-like means 40.

Reference will be had first to the nature of the construction of the first channel-like means 40, and in particular for this purpose to FIGS. 3–6 of the drawing. To this end, the first channel-like means 40, as will be best understood with reference to FIG. 3 of the drawing, is operative to define a plurality of individual channel-like passages, each of which for ease of reference has been denoted in the drawing by the same reference numeral, i.e., the reference numeral 44. More specifically, in accord with the best mode embodiment of the invention and as will be best understood with reference to FIG. 3 of the drawing, the first channel-like means 40 preferably encompasses six such first channel-like passages in each 60° sector of the circumference of the grinding table 16, or a total of thirty-six such first channel-like passages 44, six per 60° sector, located around the entire circumference of the grinding table 16 in surrounding relation thereto.

Figure 3:
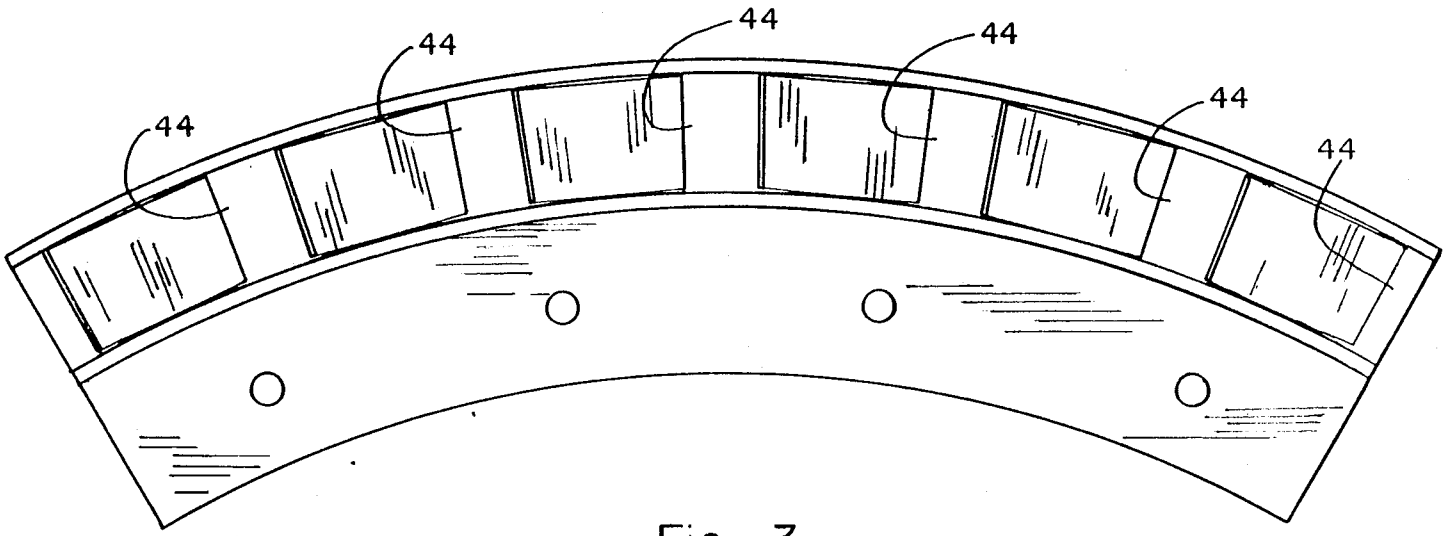
FIG. 3 is a top plan view of the first channel-like means of a vane wheel assembly for bowl mills constructed in accordance with the present invention.
Figure 6:
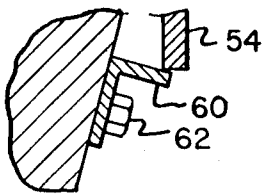
FIG. 6 is a cross-sectional view on an enlarged scale of a portion of the vane wheel assembly for bowl mills constructed in accordance with the present invention shown in FIG. 4 of the drawing, illustrating the manner in which one end of the first channel-like means of the vane wheel assembly is mounted in supported relation on the bowl of the bowl mill.
Figure 5:
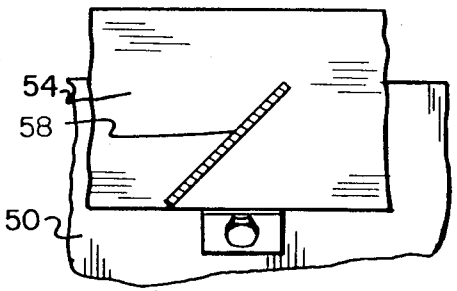
FIG. 5 is a cross-sectional view of a vane wheel assembly for bowl mills constructed in accordance with the present invention taken substantially along the line 5—5 in FIG. 4 of the drawing.
Figure 4:
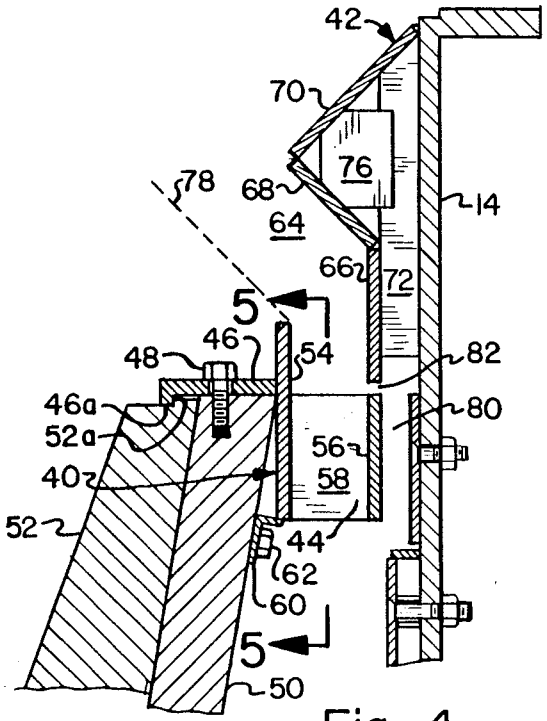
FIG. 4 is a cross-sectional view of a vane wheel assembly for bowl mills constructed in accordance with the present invention illustrated installed in a bowl mill.

Continuing with the description of the nature of the Oconstruction of the first channel-like means 40, the latter as will be best understood with reference to FIGS. 3 and 4 of the drawing includes a plurality of extension ring segments 46. More specifically, in accord with the best mode embodiment of the invention there are preferably provided six such segments 46, i.e., one such segment 46 per each 60° sector of the circumference of the grinding table 16. Moreover, each of the extension ring segments 46 is suitably mounted on the grinding table 16 through the use of any conventional form of fastening means, such as through the use of a plurality of threaded fasteners, one of which can be seen at 48 in FIG. 4 of the drawing. With further reference to the extension ring segments 46, each of the latter, which are each substantially planar in configuration, has a projection, denoted in FIG. 4 by the reference numeral **46*a* formed at one end thereof. To this end, as best understood with reference to the illustration thereof in FIG. 4, each of the extension ring segments 46 is designed, when installed, to lie in a substantially horizontal plane, i.e., substantially perpendicular to the vertical axis of the bowl mill 10 such that the planar portion of the extension ring segments 46 is positioned in abutting engagement with both the bowl portion, the latter being denoted by the reference numeral 50 in FIG. 4, of the grinding table 16 and with a segment of the bull ring, the latter being denoted by the reference numeral 52 in FIG. 4, which in a manner well-known to those skilled in the art of bowl mills is supported in mounted relation on the bowl portion 50 of the grinding table 16. Furthermore, when the extension ring segments 46 are so positioned relative to the bowl portion 50 and the bull ring 52 of the grinding table 16, the projection 46*a* thereof, with which as described previously herein each of the extension ring segments 46 is suitably provided at one end thereof, is positioned in interlocking engagement with a projection 52*a* which is suitably formed at the upper end as viewed with reference to FIG. 4 of the bull ring 52 and which embodies a configuration that is complementary to that of the aforereferenced projection 46*a* of the extension ring segments 46**.

Referring further to the nature of the construction of the first channel-like means 40, each of the plurality of first channel-like passages 44 that the first channel-like means 40 encompasses is constructed in the same fashion. Accordingly, for purposes of obtaining an understanding of the manner in which each of the plurality of first channel-like passages 44 is constructed, it is deemed sufficient to describe in detail herein the nature of the construction of only one of the plurality of first channel-like passages 44. In this regard, reference will be had to FIG. 4 of the drawing. Thus, referring to FIG. 4 each of the plurality of first channel-like passages 44 that the first channel-like means 40 encompasses is defined as will be readily apparent therefrom by a first side wall member 54, a second side wall member 56 and a pair of end wall members 58, only one of which has been depicted in FIG. 4 in the interest of maintaining clarity of illustration therein.

With further reference thereto, the first side wall member 54, the second side wall member 56 and the pair of end wall members 58 of the first channel-like passages 44 are all interconnected one to another through the use of any conventional form of fastening means suitable for securing a plurality of members one to another. One conventional form of fastening means which is suitable for use for this purpose is welding. Insofar as the interconnection of the first side wall member 54, the second side wall member 56 and the pair of end walls 58 is concerned, it is important to take note here of the fact that the first side wall member 54, the second side wall member 56 and the pair of end walls 58 by design are all spaced a predetermined specified distance from each other. This is in order to provide the first channel-like passage 44 with an area of predetermined dimensions which corresponds to the area that is required in order to enable the highest expected volume of air to flow through the first channel-like means 40 at a preestablished specified velocity wherein the highest expected volume of air is the volume of air that is designed to flow through the first channel-like means 40 at the highest allowable air inlet temperature. In accord with the best mode embodiment of the invention the preestablished specified velocity to which reference is had here is approximately 125 ft./sec. which is considered to be a low velocity when compared to bowl mills embodying prior art forms of deflector means wherein the velocity of the air flowing through such prior art forms of deflector means is known to be on the order of 225 ft./sec., or almost twice the velocity of the air flowing through the first channel-like means 40 of the vane wheel assembly 12 constructed in accordance with the present invention.

Continuing, as will be readily apparent from a reference to FIG. 4 of the drawing, the first side wall member 54 for a purpose which will become clearer from the description that follows hereinafter embodies a significantly longer length than does the second side wall member 56. It can also be seen with reference to FIG. 4 of the drawing that the first side wall member 54, the second side wall member 56 and the pair of end wall members 58 collectively are operative to define a first channel-like passage 44 the major axis of which extends in a vertical direction, i.e., in substantially parallel relation to the major axis of the bowl mill 10 itself.

For purposes of completing the description of the plurality of first channel-like passages 44, there will now be set forth herein a description of the manner in which the plurality of first channel-like passages 44 are each mounted in supported relation on the exterior of the grinding table 16. In this regard, reference will be had in particular to FIGS. 4 and 6 of the drawing. With reference first to FIG. 4 of the drawing, as depicted therein the first side wall member 54, the second side wall member 56 and the pair of end wall members 58 which when collectively interconnected together define one of the plurality of first channel-like passages 44 are mounted in supported relation on the exterior of the grinding table 16 in the following manner. First, as will be best understood with reference to FIG. 4, the first side wall member 54 is secured both to the extension ring segment 46 and to the bowl portion 50 of the grinding table 16. More specifically, the first side wall member 54 in accord with the best mode embodiment of the invention is preferably secured at a point located in spaced relation to one end thereof to the extension ring segment 46 such as by being welded thereto. While, at the other end thereof the first side wall member 54 is secured to a bracket, the latter being denoted by the reference numeral 60 in both FIGS. 4 and 6, and therethrough to the bowl portion 50 of the grinding table 16. Furthermore, the bracket 60, which in accord with the illustration thereof in FIGS. 4 and 6 of the drawing preferably is L-shaped in configuration, is itself secured to the outer surface of the bowl portion 50 of the grinding table 16 through the use of conventional fastening means such as the threaded fastener 62 shown in FIGS. 4 and 6 so that the lower end, as viewed with reference to FIG. 4, of the first side wall member 54 rests thereon and in accord with the best mode embodiment of the invention is preferably also welded thereto. Thus, it should now be readily apparent from the preceding discussion that inasmuch as the first side wall member 54, the second side wall member 56 and the pair of end wall members 58 are all interconnected together so as to thereby form an integral unit, and since the first side wall member 54 is mounted in supported relation on the exterior surface of the body portion 50 of the grinding table 16, the second side wall member 56 and the pair of end wall members 58 by virtue of their interconnection to the first side wall member 54 are likewise, therefore, to be perceived as being mounted in supported relation on the exterior of the surface of the grinding table 16.

It is important that note be taken here of the manner in which the position of the first channel-like means 40 and thereby of the plurality of first channel-like passages 44 relative to the grinding table 16 is determined. To this end, as discussed herein previously a main objective of the present invention is to provide a structure whereby air is made to flow through the vane wheel assembly 12 of the bowl mill 10 at a very low velocity as compared to the velocity at which the air has heretofore been made to flow through the bowl mills equipped with prior art forms of deflector means which have existed previously. The desirability of employing such a low velocity flow of air stems from the fact that a number of advantages are known to be derivable therefrom. Moreover, these advantages have been enumerated herein previously. Accordingly, it is not deemed necessary that they be reiterated herein at this point. Rather, it is deemed sufficient to merely point out herein once again the manner in which in accordance with the present invention this low velocity flow of air is accomplished. Namely, it results from there being provided a structure wherein the vane wheel assembly 12 in accordance with the present invention includes a first channel-like means 40 and a second channel-like means 42, and wherein the first channel-like means 40 in accordance with the description thereof which has been set forth hereinbefore encompasses a plurality of first channel-like passages 44, each being defined by a first side wall member 54, a second side wall member 56 and a pair of end wall members 58, all of which by design are spaced a predetermined distance apart whereby the first channel-like means 40 is made to embody an area of predetermined dimensions corresponding to the area which is required in order that the highest expected volume of air, i.e., the volume of air that is designed to flow through the first channel-like means 40, is made to flow through the first channel-like means 40 at a preestablished specific velocity, which in accord with the best mode embodiment of the invention is a velocity of 125 ft./sec. Moreover, the first step in the establishment of this area of predetermined dimensions is that of properly locating the first side wall member 54 relative to the exterior surface of the grinding table 16. Then, by using the first side wall member 54 as a reference it is possible to establish the location of the second side wall member 56 relative to the first side wall member 54. In summary, therefore, by virtue of the fact that the location of the first side wall member 54 is established relative to the exterior surface of the grinding table 16 and the location of the second side wall member 56 in turn is established relative to the first side wall member 54, the net effect thereof is that the location of the second side wall member 56 is also established by reference to the exterior surface of the grinding table 16. Thus, particular note should be taken here of the fact that in establishing the area of predetermined dimensions for the first channel-like means 40 the reference point that is utilized for this purpose is the exterior surface of the grinding table 16 and not the interior surface of the millside area 15 of the bowl mill 10.

There will next be set forth herein a description of the nature of the construction in accordance with the present invention of the second channel-like means 42 of the vane wheel assembly 12. For this purpose reference will be had in particular to FIGS. 2 and 4 of the drawing. With reference to FIG. 4 first, the second channel-like means 42 as has been stated previously herein is mounted in fixed relation on the interior of the millside area 15 of the bowl mill 10 at the exit, i.e., the outlet, end of the first channel-like means 40 so as to extend a full 360° around the circumference of the millside area 15 and so as to lie in a second plane that extends in a second direction that is inclined at a predetermined angle to the first plane of the first channel-like means 40. Furthermore, in accord with the best mode embodiment of the invention, the second channel-like means 42 includes a second channel-like passage, the latter being identified in FIG. 4 by the reference numeral 64.

Continuing, the second channel-like passage 64 in accord with the present invention embodies an area of predetermined dimensions. In accordance with the best mode embodiment of the present invention the area of predetermined dimensions that the second channel-like passage 64 embodies corresponds to the area which is required so that the air when flowing through the second channel-like passage 64 of the second channel-like means 42 will flow therethrough at a preestablished specific velocity that bears a fixed relationship to the velocity of the air when flowing through the first channel-like means 40. In accord with the best mode embodiment of the invention, this fixed relationship that the velocity of the air flowing through the first channel-like means 40 bears to the velocity of the air flowing through the second channel-like means 42 constitutes a ratio of 1.6–1.7 to 1. There will be set forth hereinafter a definition of the area of predetermined dimensions which the second channel-like passage 64 embodies. However, before this is done there is a need to describe further herein the nature of the construction of the second channel-like means 42. To this end, as will be best understood with reference to FIG. 4 of the drawing, the second channel-like means 42 includes a plurality of first members each denoted in the drawing by the same reference numeral 66, a plurality of second members each denoted in the drawing by the same reference numeral 68 and a plurality of third members each denoted in the drawing by the same reference numeral 70. Preferably, in accord with the best mode embodiment of the invention the plurality of first members 66, the plurality of second members 68 and the plurality of third members 70 each comprise six in number. Namely, in accord with the best mode embodiment of the invention, there is provided one first member 66, one second member 68 and one third member 70 for each 60° sector of the inside circumference of the bowl mill 10.

Considering first the plurality of first members 66, inasmuch as all of the first members 66 are mounted in fixed relation within the interior of the bowl mill 10 in the same manner it is not deemed necessary to describe herein in detail the manner in which each of the plurality of first members 66 are mounted. Rather, it is deemed sufficient for purposes of obtaining an understanding of the present invention to describe herein in detail the manner in which one such first member 66 is mounted in fixed relation to the interior of the millside area 15 of the bowl mill 10. To this end, as best understood with reference to FIG. 4 of the drawing, it can be seen therefrom that the first member 66 is supported in spaced relation to the interior surface of the millside area 15 of the bowl mill 10 and so as to lie in the same vertical plane as the second side wall member 56 of the first channel-like means 40 but in slightly spaced relation thereto with the spacing existing therebetween being approximately ½ inch. With further reference thereto, the first member 66 is preferably supported in spaced relation to the interior surface of the millside area 15 of the bowl mill IO by means of a spacer member, the latter being depicted in FIG. 4 wherein the spacer member is identified by the reference numeral 72. More specifically, the first member 66 is fastened to the spacer member 72 through the use of any conventional form of fastening means such as by being welded thereto. Spacer member 72 itself in turn is secured to the inner surface of the millside area 15 of the bowl mill 10 through the use of any conventional form of securing means such as, for example, by being welded thereto.

Turning next to the matter of the plurality of second members 68, as in the case of the plurality of first members 66, a description will be had herein of the manner in which only one of the plurality of second members 68 is mounted in fixed relation within the interior of the millside area 15 of the bowl mill 10 since each of the plurality of second members 68 is mounted within the bowl mill 10 in the same manner. In this regard, reference will once again be had to FIG. 4 of the drawing. As best understood with reference thereto, second member 68 is supported in spaced relation to the inner surface of the millside area 15 of the bowl mill 10 such as to lie in a plane which is inclined at a predetermined angle to the plane in which the first member 66 lies. In accord with the best mode embodiment of the invention, the second member 68 lies in a plane which is inclined at a 45° angle to the plane of the first member 66. Continuing, the second member 68 has one end thereof secured in abutting relation with the upper end, as viewed with reference to FIG. 4 of the drawing, of the first member 66 such as by being welded thereto. The other end of the second member 68, on the other hand, is secured in abutting relation with one end of the third member 70, to which further reference will be made herein subsequently, such as by being welded thereto. Further, the second member 68 is preferably supported intermediate its ends by a support member, the latter being depicted in FIG. 4 wherein the support member is identified by the reference numeral 76, and to which the second member 68 is preferably secured such as by being welded thereto. The support member 76 in turn is itself secured to the spacer member 72 intermediate the ends of the latter such as by being welded thereto.

Finally, as regards the matter of the plurality of third members 70, since each of the plurality of third members 70 is mounted in fixed relation to the interior of the millside area 15 of the bowl mill 10 in the same manner, the mounting of only one such third member 70 will be described herein in detail as has also been done in the case of both the plurality of first members 66 and the plurality of second members 68 which have been described herein previously. Thus, with reference to FIG. 4 of the drawing, as will be best understood with reference thereto the third member 70 is supported relative to the interior surface of the millside area 15 of the bowl mill 10 so as to lie in a plane that is inclined at an angle of approximately 90° to the plane in which the second member 68 lies. To this end, the third member 70, as has been set forth herein previously, has one end thereof secured in abutting relation with one end of the second member 68 such as by being welded thereto. Whereas, the other end of the third member 70 is secured in abutting relation with the inner surface of the millside area 15 of the bowl mill 10 such as by being welded thereto. Finally, intermediate its ends the third member 70 is preferably supported by means of the support member 76 in essentially the same manner as that in which the second member 68 is supported intermediate its ends by the support member 76 and to which mention has previously been had hereinbefore. That is, the support member 76 is preferably secured to the third member 70 such as by being welded thereto as well as by being also secured to the spacer member 72 such as by being welded thereto.

Returning now once again to the matter of the manner of how the area of predetermined dimensions which the second channel-like passage 64 embodies is defined, reference will be had for this purpose to FIG. 4 of the drawing. As best understood with reference to FIG. 4, the area of predetermined dimensions which the second channel-like passage embodies is defined as the area which lies between the second member 68 on the one hand and an imaginary line, the latter being indicated in FIG. 4 by the dotted line that is identified therein by the reference numeral 78. To this end, the imaginary line 78 lies in a plane which is parallel to the plane of the second member 68. Accordingly, the imaginary line 78 is inclined at an angle of 45° relative to the upper end, as viewed with reference to FIG. 4 of the drawing, of the first side wall member 54 of the first channel-like means 40. As such, the area which the second channel-like passage 64 embodies is inclined at an angle of 45° to the area that the first channel-like means 40 embodies such that air exiting from the first channel-like passages 44 of the first channel-like means 40 in flowing through the second channel-like passage 64 is made to undergo a deflection of 45°, caused by the engagement thereof with the second member 68, in order to flow through the second channel-like passage 64 after leaving the first channel-like passages 44.

There will now be set forth herein a description of the manner in which the air is made to flow through a bowl mill such as the bowl mill 10 depicted in FIG. 1 when equipped with a deflector means such as the vane wheel assembly 12 constructed in accordance with the present invention. For this purpose, reference will be had in particular to FIG. 1 of the drawing. With reference thereto air enters the bowl mill 10 through the opening 36 with which the bowl mill 10 is provided for this purpose. Thereafter, the air flows upwardly around the exterior of the grinding table 16. Then, virtually all the air enters the first channel-like means 40 of the vane wheel assembly 12. However, as best understood with reference to FIG. 4 of the drawing, a relatively small amount of air does flow through the space, seen at 80 in FIG. 4, which exists between the inner surface of the millside area 15 of the bowl mill 10 and the outer surface of the second side wall member 56 of the first channel-like passage 44. After passing through the space 80, this relatively small amount of air flows through the space, seen at 82 in FIG. 4, which exists between the upper edge, as viewed with reference to FIG. 4 of the second side wall member 56 of the first channel-like passage 44 and the lower edge, as viewed with reference to FIG. 4, of the first member 66 of the second channel-like passage 64 whereupon this relatively small amount of air after passing through the the space 82 recombines with the air exiting from the first channel-like passage 44. Inasmuch as the air that flows through the space 80 and the space 82 is relatively negligible as compared to the amount of air that flows through the first channel-like passages 44 of the first channel-like means 40 it is of virtually little consequence insofar as the path of flow of the air through the bowl mill 10 is concerned.

With further regard to the description of the manner in which the air is made to flow through the bowl mill 10 when equipped with the vane wheel assembly 12 constructed in accordance with the present invention, because the first channel-like means 40 in accordance with the present invention embodies an area of predetermined dimensions the air when flowing therethrough is made to flow at a preestablished specific velocity which in accord with the best mode embodiment of the invention is a velocity of 125 ft./sec. Furthermore, the air upon exiting from the first channel-like means 40 is then made to flow through the second channel-like passage 64. In doing so, the air is forced to undergo a deflection by virtue of its engagement with the second member 68 so as to change direction and flow in a second direction which is inclined at 45° to the direction in which the air is flowing when the air exits from the first channel-like means 40. Note is made here of the fact that the second member 68 may be coated with a wear-resistant material, or alternatively, formed entirely of a wear-resistant material for purposes of reducing the wear thereto occasioned by the engagement therewith of the air exiting from the first channel-like passages 44 of the first channel-like means 40. Continuing, by virtue of the fact that the second channel-like passage 64 in accordance with the present invention embodies an area of predetermined dimensions the air when flowing therethrough is made to flow at a preestablished specific velocity that bears a fixed relationship to the preestablished specific velocity with which the air flows through the first channel-like means 40 and which in accordance with the present invention comprises a ratio whereby the air flows through the first channel-like means 40 at a velocity which is 1.6 to 1.7 times the velocity at which the air flows through the second channel-like passage 64. During this flow of the air through the vane wheel assembly 12 constructed in accordance with the present invention the velocity of the air flow through the first channel-like means 40 is sufficient such that upon exiting from the first channel-like means 40 the air is operative to entrain therewithin the particles of material that have been pulverized on the grinding table 16. Thereafter, when the air in which the particles are entrained is made to deflect in order to flow through the second channel-like passage 64 those particles which are larger in size than desired in the course of undergoing this deflection lose their momentum and fall back onto the surface of the grinding table 16 whereupon they are subjected to further pulverization. Thus, it can be seen from the foregoing that by virtue of the nature of the construction of the vane wheel assembly 12 of the present invention, the air while moving at a low velocity, i.e., 125 ft./sec. as compared to the velocity, i.e., 225 ft./sec., at which the air is made to flow through bowl mills equipped with prior art forms of deflector means remains operative to effect a primary classification according to size of the particles that undergo pulverization in the bowl mill 10 while yet flowing at a sufficiently low velocity so that the advantages to be derived from such a low velocity flow of air are realized.

In accordance, therefore, with the present invention there has been provided a new and improved vane wheel assembly that is suitably constructed so as to be employable in a bowl mill for purposes of effecting a primary classification of the material that is pulverized in the bowl mill. Moreover, there is provided in accord with the present invention a vane wheel assembly for bowl mills wherein by virtue of the low velocity at which the air is made to flow through the vane wheel assembly there results a lower pressure drop across the bowl portion of the bowl mill and thereby a reduction in the total pressure drop across the bowl mill with the concomitant result that for the same flow of pulverized material through the bowl mill it is possible to realize either a gain in air flow or a reduction in power consumption. Also, in accordance with the present invention there is provided a vane wheel assembly for bowl mills wherein by virtue of the low velocity at which the air is made to flow through the vane wheel assembly there results a better classification within the bowl mill of the particles of pulverized material and thus better fineness control. Further, there is provided in accordance with the present invention a vane wheel assembly for bowl mills wherein by virtue of the low velocity at which the air is made to flow through the vane wheel assembly the separator body internals of the bowl mill are subjected to less wear. In addition, in accordance with the present invention there is provided a vane wheel assembly for bowl mills wherein by virtue of the low velocity at which the air is made to flow through the vane wheel assembly the upper millside area of the bowl mill is subjected to less wear. Furthermore, there is provided in accord with the present invention a vane wheel assembly for bowl mills which is suitable for employment in retrofit applications as well as being suitable for employment in newly constructed bowl mills. Finally, in accordance with the present invention there is provided a vane wheel assembly for bowl mills which is advantageously characterized by its ease of manufacture and its ease of installation in a bowl mill, as well as by the fact that it is relatively inexpensive to provide.

While only one embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. In a bowl mill having a substantially closed body portion including a millside area, a rotatable grinding surface having a circumference and mounted within the millside area so as to be rotatable relative thereto, at lease one grinding roll mounted within the bowl mill so as to coact with the rotatable grinding surface, and an annular passage formed between the circumference of the rotatable grinding surface and the millside area so as to enable air to flow upwardly through the annular passage, the improvement comprising a vane wheel assembly for use in the bowl mill so as to be operative to effect a primary classification of the material that is subject to pulverization within the bowl mill comprising:

(a) first channel-like means mounted in supported relation on the exterior of the grinding surface for rotation therewith and so as to lie in a first plane that extends in a first direction, said first channel-like means defining a plurality of first channel-like passages, said plurality of first channel-like passages each being defined by a first side wall member supported on the exterior surface of the grinding surface so as to lie in a plane extending parallel to the major axis of the bowl mill and so as to have a portion thereof extending above the grinding surface, a pair of end wall members each connected to said first side wall member and a second side wall member connected to each of said pair of end wall members so as to be supported thereby in spaced relation to said first side wall member in a plane extending parallel to the plane of said first side wall member, said second side wall member being of lesser length than said first side wall member so as to terminate at a point substantially flush with the grinding surface when supported in spaced relation to said first side wall member by said pair of end wall members, said first side wall member and said second side wall member an said pair of end wall members all being interconnected together so as to be spaced at predetermiend distances one from another such as to define therebetween an area of predetermined dimensions corresponding to the area required in order that the highest volume of air expected at the highest allowable inlet temperature of the air to the bowl mill may flow through said plurality of first channel-like passages at a prestablished specified velocity; and (b) second channel-like means mounted in fixed relation on the interior of the millside area at the exit end of said first channel-like means so as to extend a full 360° around the circumference of the millside area and so as to line in a second plane that extends in a second direction that is inclined at a predetermined angle to said first plane of said first channel-like means, said second channel-like means defining a second channel-like passage having the major axis thereof inclined at said predetermined angle to the major axis of each of said plurality of first channel-like passages, said second channel-like passage embodying an area of predetermined dimensions corresponding to the air required in order that the air when flowing through said second channel-like passage flows at a preestablished specified velocity that bears a fixed relationship to the velocity of the air when the air is flowing through said plurality of first channel-like passages, said second channel-like passage including a plurality of first members supported in spaced relation to the inside surface of the millside area such that said plurality of first members lie in the same plane as said second side wall members of said plurality of first channel-like passages and each having one end thereof spaced slightly from a corresponding one of said second side wall members of said plurality of first channel-like passages, a plurality of second members each having one end thereof secured to the other end of a correspnding one of said plurality of first members such that said plurality of second members are inclined at a predetermined angle to said plurality of first members, and a plurality of third members each having one end thereof secured to the other end of a corresponding one of said plurality of second members such that said plurality of third members extend substantially perpendicular to said plurality of second members with the other end of each of said plurality of third members being supported in spaced relation to the inside surface of the millside area.

2. In a bowl mill as set forth in claim 19 wherein said plurality of first channel-like passages total thirty-six in number arrranged six per 60° sector around the exterior of the grinding surface.

3. In a bowl mill as set forth in claim 1 wherein said plurality of second members extend at a 45° angle to said plurality of first members.

4. In a bowl mill as set forth in claim 3 wherein said plurality of first members total six in number arranged one per 60° sector around the interior of the millside area.

5. In a bowl mill as set forth in claim 4 wherein said plurality of second members total six in number arranged one per 60° sector around the interior of the millside area.

6. In a bowl mill as set forth in claim 5 wherein at least the outer surface of each of said plurality of second members is formed of a wear-resistant material.

7. In a bowl mill as set forth in claim 6 wherein said plurality of third members total six in number arranged one per 60° sector around the interior of the millside area.

8. In a bowl mill as set forth in claim 7 wherein said preestablished specified velocity at which the air flows through said plurality of first channel-like passages is 125 ft./sec.

9. In a bowl mill as set forth in claim 8 wherein said fixed relationship that said preeestablished specified velocity of said first channel-like means bears to said preestablished specified velocity of said second channel-like means is a ratio of 1.6–1.7 to 1.

* * * * *